US005611703A

United States Patent [19]

Okamoto et al.

[11] Patent Number: 5,611,703

[45] Date of Patent: Mar. 18, 1997

[54] LEVER-TYPE CONNECTOR

[75] Inventors: Kenichi Okamoto; Naoto Taguchi, both of Shizuoka, Japan

[73] Assignee: Yazaki Corporation, Tokyo, Japan

[21] Appl. No.: 522,819

[22] Filed: Sep. 6, 1995

[30] Foreign Application Priority Data

Sep. 6, 1994 [JP] Japan ..... 6-212874

[51] Int. Cl.[6] ..... H01R 13/62

[52] U.S. Cl. ..... 439/157; 439/153

[58] Field of Search ..... 439/152–160, 439/372

[56] References Cited

U.S. PATENT DOCUMENTS

| | | | |
|---|---|---|---|
| 5,368,492 | 11/1994 | Hayashi | 439/157 |
| 5,427,540 | 6/1995 | Taguchi | 439/157 |
| 5,453,018 | 9/1995 | Ito et al. | 439/153 |
| 5,474,461 | 12/1995 | Saito et al. | 439/157 |
| 5,474,462 | 12/1995 | Yamanashi | 439/157 |
| 5,476,390 | 12/1995 | Taguchi et al. | 439/155 |
| 5,482,394 | 1/1996 | Shinchi et al. | 439/157 |

FOREIGN PATENT DOCUMENTS 4-87169 3/1992 Japan .

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A lever-type connector in which the need for a resilient member is obviated, thereby saving cost, and including engagement portions are less liable to damage or to deterioration due to aging when a large impact force is accidentally applied, this impact force can be effectively relieved, thereby preventing damage to the engagement portions. The lever-type connector includes a pair of female and male connectors. Engagement shafts are formed on the male connector, and a retaining lever, having fitting grooves, is mounted on the female connector for pivotal movement about support shafts. When the retaining lever is pivotally moved, the engagement shafts are forcibly moved through the fitting grooves, thereby fitting the male connector into the female connector. A lock portion is formed on a front surface of the retaining lever directed in a direction of pivotal movement of the retaining lever, and a lock arm, having a lock arm retaining piece portion engageable with the lock portion, is formed on a wall of the female connector at such a position that the lock arm can be engaged with the lock portion of the pivotally-moving retaining lever, and at least one of the lock arm retaining piece portion and the lock arm is elastically deformable.

5 Claims, 5 Drawing Sheets

LEVER-TYPE CONNECTOR

BACKGROUND OF THE INVENTION

1. Field of the Invention

This invention relates to a lever-type connector used mainly for connecting wire harnesses together in an automobile, which connector can be operated with a low insertion/withdrawal force.

2. Background

One conventional, well-known connector of the type described is disclosed in Japanese Patent Unexamined Patent Publication No. 4-87169, which connector employs a spring as shown in FIGS. 8 and 9.

In FIG. 8, a female connector 102 includes a pivotal cam lever 103 having a lock projection 104, and the cam lever 103 is urged upwardly by a coil spring 106 mounted on a support shaft provided at an inner end thereof. A male connector 101, having a lock portion 108, is inserted at its front end portion into a front opening in the female connector 102, and then when the cam lever 103 is lowered from its raised position, the male connector is further inserted into a predetermined position within the female connector 102 with a low fitting force thanks to leverage achieved by the cam lever 103, thereby making an electrical connection between the two connectors.

As the cam lever 103 is thus lowered from its raised position after the male connector 101 is inserted into the front opening in the female connector 102, the lock projection 104 of the cam lever 103 presses down the lock portion 108 of a lock arm 107 of the male connector 101, with a slanting engagement portion 105 of the lock projection 104 held in sliding contact with a slanting engagement portion 109 of the lock portion 108, and when the two connectors are completely fitted together, the lock projection 104 slides past the lock portion 108 to be held against a lower surface of the lock portion 108, so that the two connectors are held in a completely-fitted or retained condition as shown in FIG. 9.

Here, if the cam lever 103 is held in its lowered position during the fitting of the male connector 101 into the female connector 102, the male connector 101 is prevented from advancing, and can not be inserted any further. The coil spring (resilient member) 106 is provided for overcoming this, and with this construction the cam lever 103 is urged into its initial or raised position by the resilient force of the coil spring 106 so that the cam lever will not prevent the male connector from advancing.

When the two connectors 101 and 102 have not yet been completely fitted together, the lock projection 104 is not retainingly engaged with the lock portion 108, so that the cam lever 103 is kept raised as shown in FIG. 8. This enables the incomplete fitting between the two connectors 101 and 102 to be easily found or confirmed.

In the above conventional technique, however, there must be provided the resilient member (the coil spring in the above example), such as a spring, which holds the cam lever (retaining lever) 103 in its predetermined initial position during the connector fitting operation, and also facilitates the confirmation of the incomplete fitting. Therefore, it has been difficult to provide the low-cost connector.

And besides, the resilient member always acts in such a manner as to urge the retaining lever back even in the completely-fitted condition, so that stresses are always applied to the engagement portions. This has resulted in a problem that even when a small external force is applied, the two connectors could be easily disengaged from each other. In addition, since stresses are always applied to the engagement portions, there has been encountered a problem that the engagement portions have been liable to damage or to deterioration due to aging.

Another problem of the conventional technique is that if an unexpectedly-large external force (impact) is accidentally applied to the retaining lever in the completely-fitted condition, the engagement portions were destroyed in an unrecoverable manner or damaged since there has not been provided any means for relieving such accidental impact force.

SUMMARY OF THE INVENTION

With the above problems in view, it is an object of this invention to provide a lever-type connector in which the need for resilient members always urging a retaining lever is obviated, thereby saving the cost, and two connectors fitted together will not be easily disengaged from each other, and engagement portions are less liable to damage or to deterioration due to aging, and even when an unexpected impact force is accidentally applied, this impact force can be effectively relieved, thereby preventing damage to the engagement portions.

The above object of the invention has been achieved by a lever-type connector comprising a pair of female and male connectors to be fitted together; an engagement shaft formed on one of the pair of connectors; a retaining lever mounted on the other connector for pivotal movement about a support shaft, the retaining lever having a fitting groove for receiving the engagement shaft, wherein the retaining lever is pivotally moved to forcibly move the engagement shaft in the fitting groove, thereby fitting the one connector relative to the other connector; wherein a lock portion is formed on a front surface of the retaining lever directed in a direction of pivotal movement of the retaining lever; a lock arm, having a lock arm retaining piece portion engageable with the lock portion, is formed on a wall of the other connector at such a position that the lock arm can be engaged with the lock portion of the pivotally-moving retaining lever; and at least one of the lock arm retaining piece portion and the lock arm is elastically deformable.

The lock portion of the retaining lever has a long portion extending generally in the direction of pivotal movement of the retaining lever, and a slanting slide surface gently slanting upwardly and inwardly from an outer end of the long portion, disposed near to a distal end of the retaining lever, relative the long portion; and the lock arm retaining piece portion of the lock arm has a long portion extending parallel to a direction of fitting of the connectors, and an outer edge formed at a lower end of the long portion of the lock arm retaining piece portion, wherein during the pivotal movement of the retaining lever, the slanting slide surface is brought into contact with the outer edge.

The lock portion of the retaining lever has a long portion extending generally in the direction of pivotal movement of the retaining lever, and an engagement surface extending at an obtuse angle relative to the long portion; and the lock arm retaining piece portion of the lock arm has a long portion extending parallel to a direction of fitting of the connectors, and an engagement surface extending at an obtuse angle relative to the long portion of the lock arm retaining piece portion, wherein when the retaining lever is pivotally moved, the engagement surface of the lock portion is engaged with the engagement surface of the lock arm retaining piece portion.

In the lever-type connector of the invention, the lock portion is formed on the front surface of the retaining lever, and the lock arm, having the lock arm retaining piece portion engageable with the lock portion, is formed on the wall of the connector having the retaining lever, and at least one of the lock arm retaining piece portion and the lock arm is elastically deformable. When the retaining lever is pivotally moved, at least one of the lock arm retaining piece portion and the lock arm is temporarily deformed elastically, thereby engaging the lock portion with the lock arm retaining piece portion.

Therefore, the need for a spring member for urging the retaining lever is obviated, and therefore the number of the component parts is reduced, thereby reducing the fraction defective and the cost.

Even if an incompletely-fitted condition is encountered during the connector-fitting operation, the lock portion and hence the retaining lever are returned by a stress produced as a result of elastic deformation of one of the lock arm retaining piece portion and the lock arm, so that the retaining lever is automatically shifted into a stable, provisionally-retained condition. Therefore, the defective products resulting from the incompletely-fitted condition can be easily detected, and also malfunction due to the incompletely-fitted condition can be prevented.

When an impact force is accidentally applied to the retaining lever, the engagement between the lock portion and the lock arm retaining piece portion each having the obtuse angle is released to thereby relieve the impact force, so that damage to the constituent parts is prevented.

DETAILED DESCRIPTION OF THE PREFERRED EMBODIMENTS

A preferred embodiment of the present invention will now be described with reference to the drawings.

Figure 1:
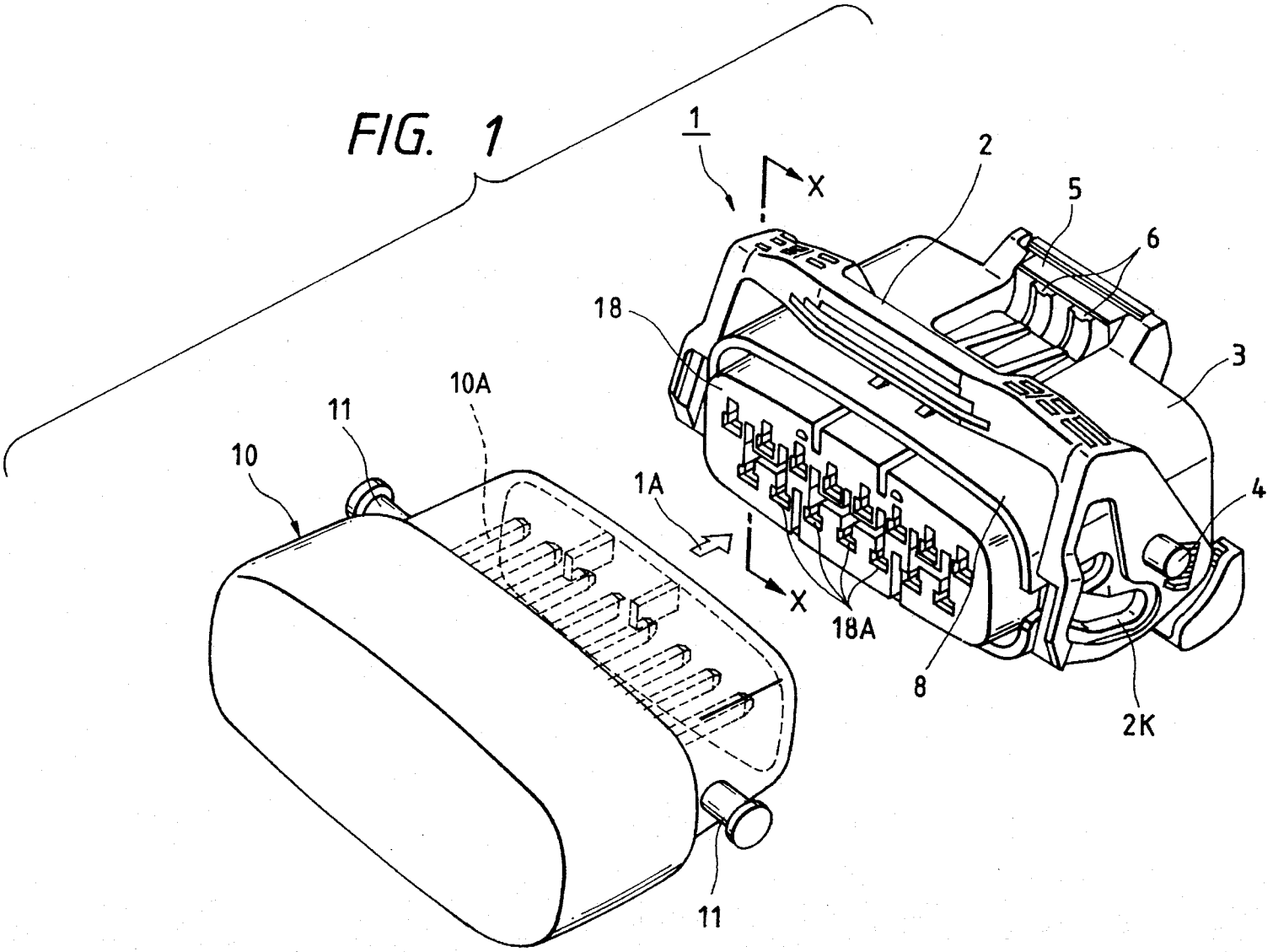
FIG. 1 is a perspective view of a preferred embodiment of a lever-type connector of the present invention.
Figure 2:
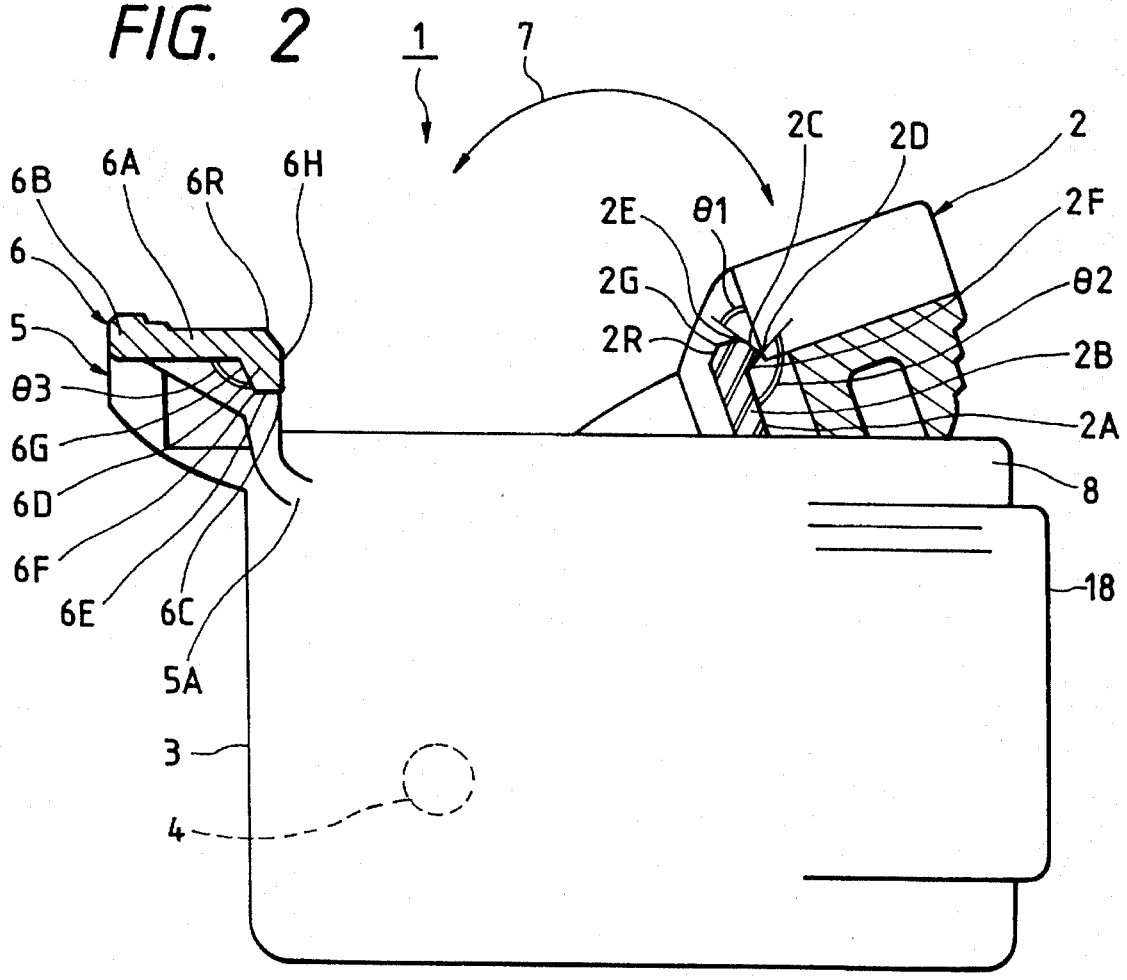
FIG. 2 is a cross-sectional view of the lever-type connector taken along the line X—X of FIG. 1.

FIG. 1 is a perspective view of one preferred embodiment of a lever-type connector of the invention, and FIG. 2 is a cross-sectional view taken along the line X—X of FIG. 1.

The lever-type connector 1 of the invention comprises a pair of female and male connectors 3 and 10, and FIG. 1 shows a condition before the male connector 10 is inserted or fitted into the female connector 3. The male connector 10 advances in a direction of arrow 1A to be fitted into the female connector 3.

The male connector 10 has a plurality of terminals mounted therein, and also has a plurality of tabs 10A provided at its front side. The male connector 10 has a pair of engagement shafts 11 respectively formed on and projecting from opposite sides thereof. The female connector 3, having a plurality of terminals 3A (see FIG. 5) mounted therein, has an outer wall forming a hollow hood 8, and a retaining lever 2 is mounted on a pair of support shafts 4, formed respectively on opposite sides of the hood 8 at a rear portion thereof, for pivotal movement about axes of the support shafts 4. A stopper 18, having a plurality of insertion holes 18A, is fitted in a front side of the female connector 3, the stopper 18 limiting the movement of elastic retaining piece portions 19 for retaining the respective terminals 3A, thereby retaining the terminals 3A in a double manner (see FIG. 5).

The retaining lever 2 has a pair of fitting grooves 2K formed respectively at its opposite sides for respectively fitting the engagement shafts 11 of the male connector 10 therein, and a lock portion 2A is formed integrally on the front surface of the retaining lever 2 directed in a direction 7 of pivotal movement of the retaining lever. 2.

A lock arm 5 is formed integrally on the rear portion of the hood 8, and is elastically deformable about a proximal portion 5A thereof so as to be engaged with the lock portion 2A of the pivotal retaining lever 2. The lock arm 5 has elastically-deformable lock arm retaining piece portions 6 formed integrally therewith.

Figure 3:
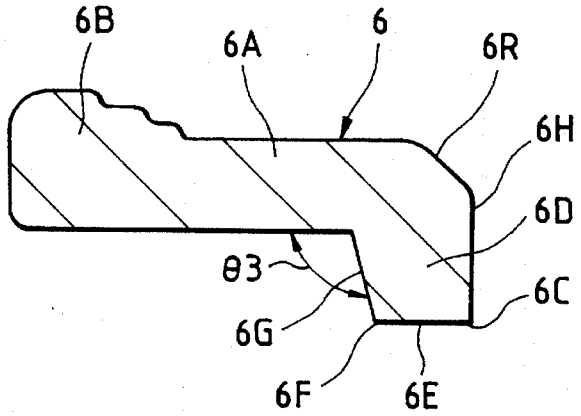
FIG. 3 is an enlarged view of a lock arm retaining piece portion.

FIG. 3 is an enlarged cross-sectional view of the lock arm retaining piece portion 6. As shown in FIG. 3, the lock arm retaining piece portion 6 is a generally L-shaped, and has a long portion 6A extending parallel to a connector-fitting direction 1A, and the lock arm retaining piece portion 6 is integrally connected to the hood 8 at one end 6B of the long portion 6A remote from the support shaft 4. Therefore, the lock arm retaining piece portion 6 is elastically displaceable or pivotally movable about the end 6B.

A depending portion 6D depends from that end of the lock arm retaining piece portion 6 close to the support shaft 4. That surface (right surface in FIG. 3) of the depending portion 6D close to the support shaft 4 defines a provisionally-retaining surface 6H generally perpendicular to the long portion 6A. A slide surface 6E extends from a lower edge or end 6*c* of the provisionally-retaining surface 6H in generally parallel relation to the long portion 6A. A guide surface 6R, slanting or curved, extends from the upper end of the provisionally-retaining surface 6H.

An engagement surface 6G extends upwardly from an inner edge or end 6F of the slide surface 6E remote from the support shaft 4. The angle θ3 between the engagement surface 6G and the long portion 6A is, for example, a right angle or an obtuse angle.

Figure 4:
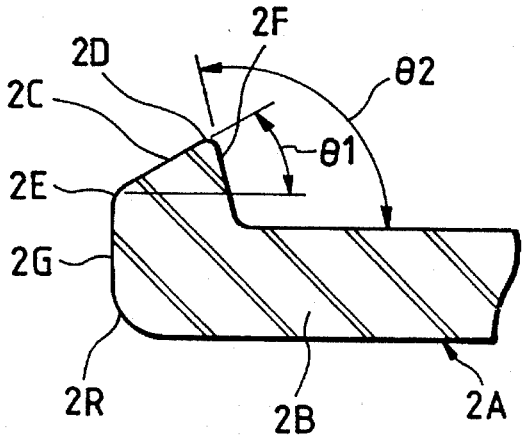
FIG. 4 is an enlarged view of a lock portion.

FIG. 4 is an enlarged cross-sectional view of the lock portion 2A. The lock portion 2A has a long portion 2B which is formed on a distal end of the retaining lever 2, and extends generally in the direction 7 of pivotal movement of the retaining lever 2. An upper surface of the distal end is defined by a slanted slide surface 2C slanting at an acute angle θ1 relative to the long portion 2B. The slanting slide surface 2C extends between an outer end 2E (close to the distal end of the retaining lever 2) and an inner end 2D, and is slanted gently upwardly from the outer end 2E to the inner end 2D relative to the long portion 2B.

A provisionally-retaining surface 2G extends downwardly from the outer end 2E in generally perpendicular relation to the long portion 2B. A guide surface 2R, slanting or curved, extends from a lower end of the provisionally-retaining surface 2G. An engagement surface 2F extends downwardly from the inner end 2D of the slanting side surface 2C to the upper surface of the long portion 2B. The angle θ2 between the engagement surface 2F and the long portion 2B is, for example, a right angle or an obtuse angle.

The operation of the lever-type connector of the invention will now be described with reference to FIGS. 5 to 7 which show a sequential fitting operation of the lever-type connector shown in FIGS. 1 and 2.

In the lever-type connector of the invention, during the fitting of the male connector 10 into the female connector 3, the engagement shafts 11 of the male connector 10 are brought respectively into contact with the surfaces of the fitting grooves 2K in the retaining lever 2, and the retaining lever 2 is pivotally moved, so that these surfaces forcibly move the engagement shafts 11, respectively. Namely, when the retaining lever 2 is pivotally moved, the engagement shafts 11, fitted respectively in the fitting grooves 2K, are forcibly moved, thereby drawing the male connector 10 during the fitting operation, so that the male connector 10 is fitted into the female connector 3 either provisionally or completely.

Figure 5:
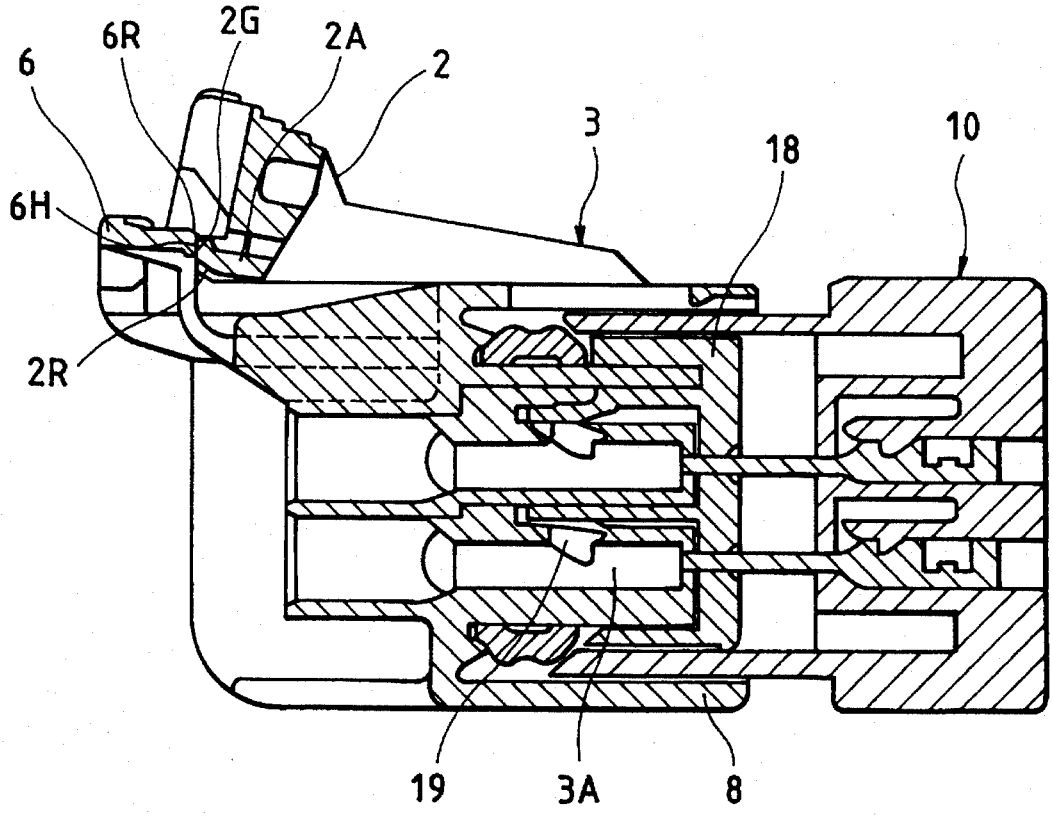
FIG. 5 is a cross-sectional view showing a provisionally-retained condition of the lever-type connector of FIG. 1.
Figure 6:
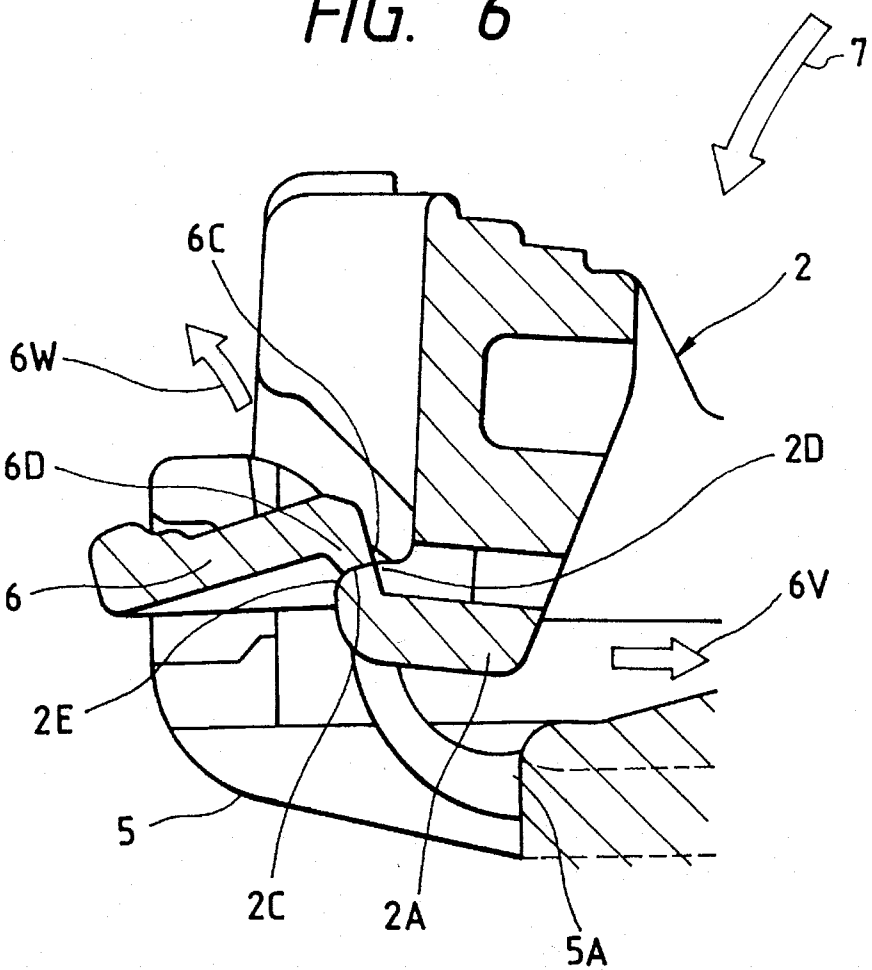
FIG. 6 is a cross-sectional view of an important portion showing a process of fitting of the lever-type connector of FIG. 1.
Figure 8:
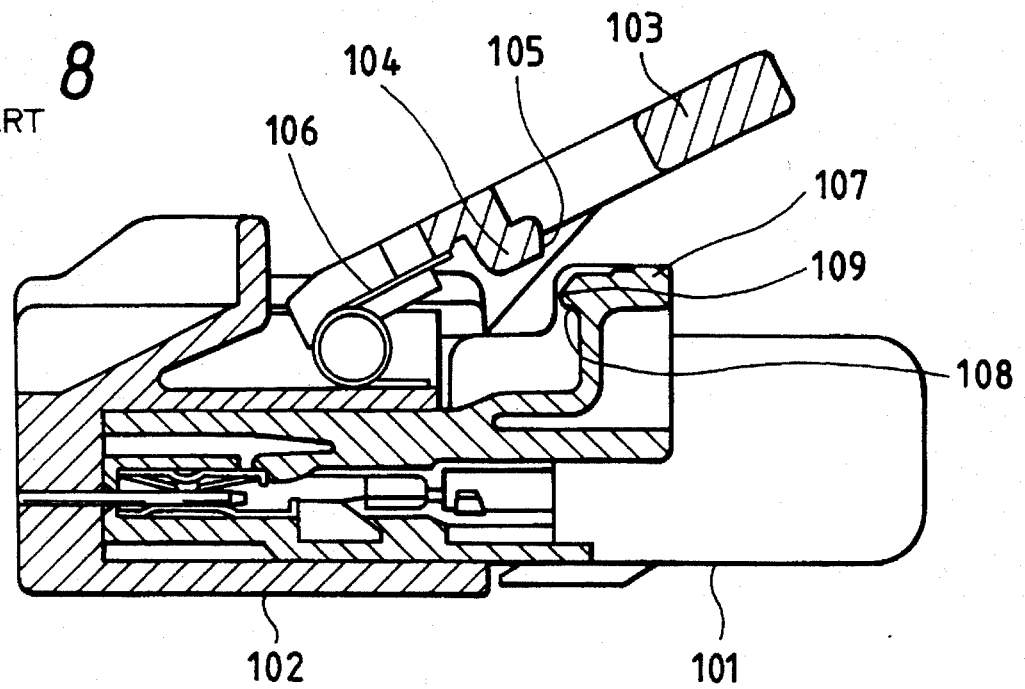
FIG. 8 PRIOR ART
FIG. 8 is a cross-sectional view of a Prior Art spring lever-type connector, showing a condition before a completely-fitted condition.
Figure 9:
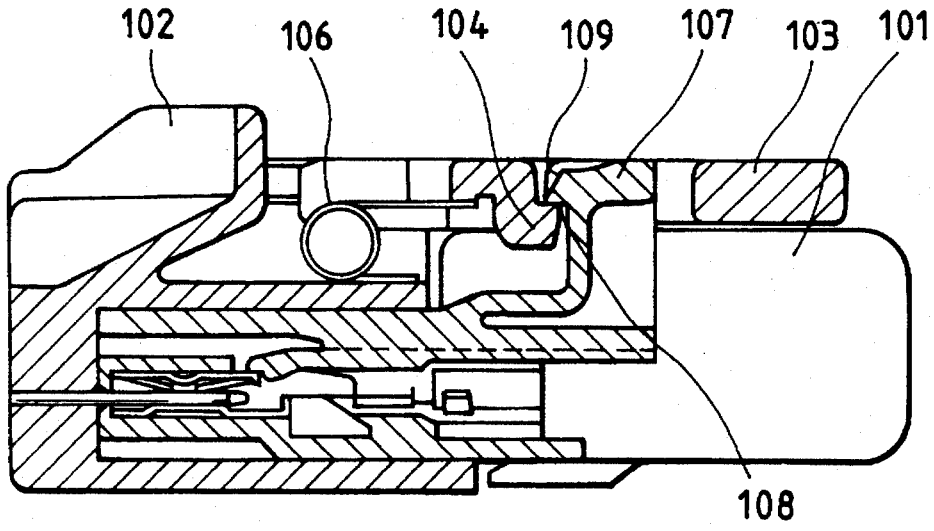
FIG. 9 PRIOR ART
FIG. 9 is a cross-sectional view of the Prior Art spring lever-type connection in its completely-fitted condition.

FIG. 5 is a cross-sectional view showing a condition in which the retaining lever 2 has been pivotally moved left in the lever-moving direction 7 from a position in which the retaining lever 2 is laid right (FIG. 2) on the upper surface of the end portion of the female connector. In this condition, the male connector 10 is provisionally retained relative to the female connector 3.

More specifically, the guide surface 2R, formed at the lower edge of the distal end of the pivotally-moving retaining lever 2, is first brought into contact with the guide surface 6R of the lock arm retaining piece portion 6 of the lock arm 5. In this condition, when the retaining lever 2 is further pivotally moved, the two smooth, slanting guide surfaces 2R and 6R slidingly move relative to each other, so that the lock portion 2A proceeds in the pivotally-moving direction. Then, the provisionally-retaining surface 2G of the lock portion 2A contacts the provisionally-retaining surface 6H of the lock arm retaining piece portion 6, so that the retaining lever 2 is retained in the position shown in FIG. 5. Namely, the retaining lever 2 is held against movement by the engagement between the two provisionally-retaining surfaces 2G and 6H, and the retaining lever 2 is provisionally retained in a stable manner in accordance with coefficients of friction of the two provisionally-retaining surfaces 2G and 6H.

Next, reference is made to the operation in which an undesirable incompletely-fitted condition is encountered during the time when the connectors are brought from this provisionally-retained condition (provisionally-fitted condition) to the completely-fitted condition. When the retaining lever 2 is further pivotally moved from the provisionally-fitted condition, the outer edge 6C, formed at the lower end of the depending portion 6D of the lock arm retaining piece portion 6 held in sliding contact with the surface of the lock portion 2A, slides past the outer end 2E of the lock portion 2A, and contacts the slanting slide surface 2C (which is slanting at the inclination angle θ1) to urge the same downwardly, as shown in FIG. 6. When the retaining lever 2 is further pivotally moved in the direction 7, the outer edge 6C moves toward the inner end 2D while held against the slanting slide surface 2C, so that the outer edge 6C is further forced upwardly. As a result, the lock arm retaining piece portion 6 is flexed to be elastically displaced in a direction 6W in FIG. 6. The flexing of the lock arm 5 at its proximal portion 5A can contribute to this elastic displacement. Because of a elastic restoring force resulting from this elastic displacement, the outer edge 6C continues to apply to the slanting slide surface 2C a force acting in a direction opposite to the elastically-displacing direction 6W.

Here, if the pivotal movement of the retaining lever 2 in the direction 7 is stopped, the outer edge 6C slides over the slanting slide surface 2C to be returned to the former position, since the elastic restoring force is exerted from the outer edge 6C to the slanting slide surface 2C, and also the slanting slide surface 2C is slanting upwardly rearwardly. As a result, the lock portion 2A (and hence the retaining lever 2) is pushed back in a direction 6V in FIG. 6, and then is returned to the provisionally-retained position where the two provisionally-retaining surfaces 2G and 6H are engaged with each other, and is stably held in this position. Thus, in the incompletely-fitted condition, the retaining lever is forcibly returned to the provisionally-retained position since the elastic restoring force is applied from the lock arm 5A to the retaining lever 2. Therefore, the incompletely-fitted condition will not last, so that inconveniences, caused by the continuation and non-detection of the incomplete condition, are eliminated.

Next, reference is made to the operation in which the connectors are brought from the provisionally-retained condition (FIG. 5) to the completely-fitted or completely-retained condition. When the retaining lever 2 is further pivotally moved from the provisionally-retained condition (FIG. 5) in the direction 7 (see FIG. 7), the outer edge 6C, formed at the lower end of the lock arm retaining piece portion 6 held in sliding contact with the surface of the lock portion 2A, slides past the outer end 2E of the lock portion 2A, and contacts the slanting slide surface 2C which is slanting at the inclination angle θ1, as described above. When the retaining lever 2 is further pivotally moved in the direction 7, the outer edge 6C moves toward the inner end 2D while urged upwardly by the slanting slide surface 2C. At this time, the lock arm retaining piece portion 6 is flexed to be elastically displaced as described above.

Then, the outer edge 6C slides past the inner end 2D, and the inner edge 6F slides past the inner end 2D whereupon the engagement surface 6G is brought into contact with the engagement surface 2F, thereby holding the retaining lever 2 in the completely-retained position. Namely, the complete fitting between the two connectors 3 and 10 is completed.

When this completely-fitted condition is achieved, the upwardly-flexed lock arm retaining piece portion 6, as well as the lock arm 5, is returned to the initial position. Thus, the elastic displacements of the lock arm retaining piece portion 6 and the lock arm 5 are released, and the elastic restoring forces are eliminated. Therefore, in the completely-fitted condition, stresses will not act on the lock portion 2A, the lock arm retaining piece portion 6 and the lock arm 5. This overcomes the problem of the conventional construction that the two connectors fitted together are disengaged from each other even if a relatively small external force is applied since this external force is added to the stresses. And besides, in the lever-type connector of the invention, no stress is exerted on the engagement portions in the completely-retained condition, and this overcomes the problem of the conventional construction that the engagement portions are subjected to damage or deterioration with time by the always-acting stresses.

Next, reference is made to the operation in which an unexpectedly-large external force (impact) is accidentally applied to the retaining lever.

The engagement surface 6G of the lock arm retaining piece portion 6 is so arranged that the angle θ3 between this surface 6G and the long portion of the lock arm retaining piece portion 6 is obtuse as shown in FIG. 3, and the engagement surface 2F of the lock portion 2A of the retaining lever 2 is so arranged that the angle θ2 between this surface 2F and the long portion of the lock portion 2A is obtuse as shown in FIG. 4.

Figure 7:
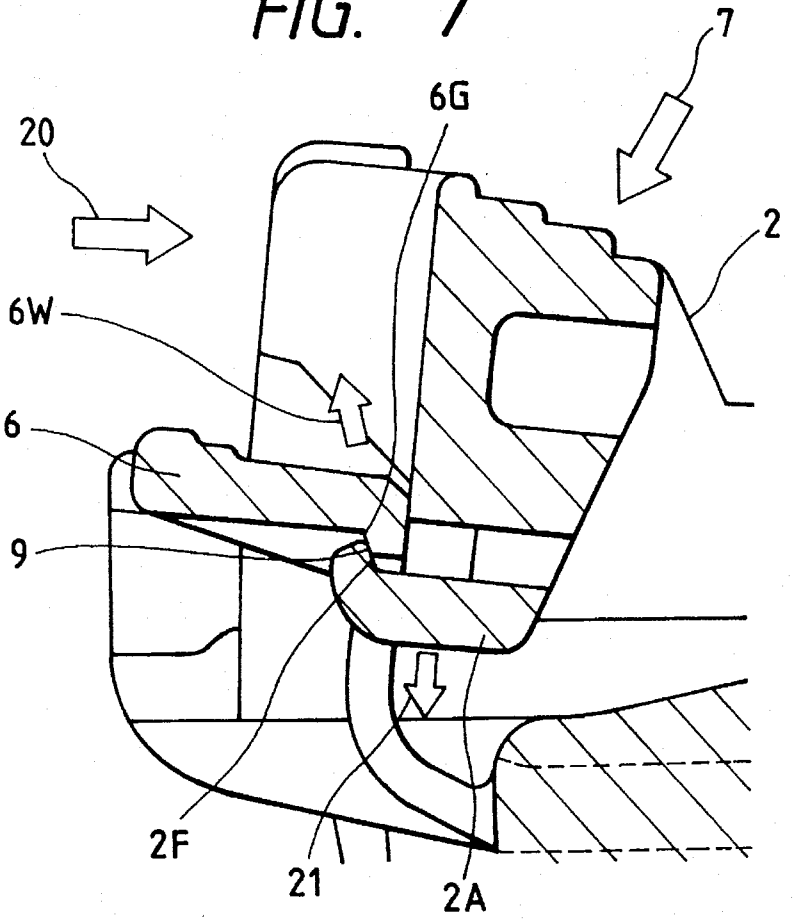
FIG. 7 is a cross-sectional view of an important portion showing a completely-fitted condition of the lever-type connector of FIG. 1.

In this case, when a large impact force 20 accidentally acts on the retaining lever 2 in a direction indicated by an arrow in FIG. 7, a force acting in the elastically-displacing direction 6W is exerted on the lock arm retaining piece portion 6 at a surface 9 of contact between the inclined engagement surfaces 2F and 6G while a downwardly-urging force 21 (directed downward in FIG. 7) is exerted on the retaining lever 2 at the contact surface 9. As a result, the engagement surfaces 2F and 6G slide relative to each other, and are disengaged from each other. Namely, the engagement between the lock portion 2A and the lock arm retaining piece portion 6 is instantaneously released, thereby preventing the large impact force 20 from acting On the engagement surfaces 2F and 6G, the lock portion 2A and the lock arm retaining piece portion 6, thus preventing damage to the engagement portions. After the accidental large impact force 20 is thus avoided, the retaining lever 2, moved from the completely-fitted position to the provisionally-fitted position, is again moved into the completely-fitted position. Therefore, the construction of this embodiment provides a kind of mechanical breaker.

Reference is made to the obtuse angle θ3 and the obtuse angle θ2. It is effective to determine the obtuse angles θ3 and θ2 in such a manner that the engagement between the lock portion 2A and the lock arm retaining piece portion 6 will not be released by an impact force of an ordinary magnitude, but will be instantaneously released without delay upon application of a large impact force as described above. The obtuse angles θ3 and θ2 may be equal to each other.

As described above, in the lever-type connector of the invention, there is no need to provide springs or the like for promoting the pivotal movement of the retaining lever. Therefore, the cost of the connector can be reduced, and the cause of malfunction is reduced by the reduction of the number of the component parts, and if the incomplete fitting occurs during the assembling, the retaining lever is automatically shifted into the provisionally-retained condition, thus facilitating defective products. And besides, when a large impact force is accidentally applied, this large impact force is relieved, thereby preventing the component parts from being damaged. Thus, the effects obtained with this construction are very advantageous from an industrial point of view.

In the above embodiment, although the retaining lever is mounted on the female connector while the engagement shafts are formed on the male connector, this can be reversed.

In the above embodiment, although the provisionally-retaining surface 6H of the lock arm retaining piece portion 6 is formed generally perpendicularly to the long portion of this piece portion 6, this is not absolutely necessary, and the provisionally-retaining surface 6H may be slanting in such a manner that the upper edge of the provisionally-retaining surface 6H is closer to the end 6B. Similarly, the provisionally-retaining surface 2G of the lock portion 2A of the retaining lever 2 may be slanting upwardly and outwardly progressively toward its upper end.

As described above, in the lever-type connector of the invention, the lock portion is formed on the front surface of the retaining lever, and the lock arm, having the lock arm retaining piece portion engageable with the lock portion, is formed on the wall of the connector having the retaining lever, and at least one of the lock arm retaining piece portion and the lock arm is elastically deformable. When the retaining lever is pivotally moved, at least one of the lock arm retaining piece portion and the lock arm is temporarily deformed elastically, thereby engaging the lock portion with the lock arm retaining piece portion. Therefore, the need for spring members for normally urging the retaining lever is obviated, and therefore the number of the component parts is reduced, thereby reducing the fraction defective and the cost.

Even if an incompletely-fitted condition is encountered during the connector-fitting operation, the lock portion and hence the retaining lever are returned by an elastic restoring force produced as a result of elastic deformation of one of the lock arm retaining piece portion and the lock arm, so that the retaining lever is automatically shifted into the stable, provisionally-retained condition. Therefore, the defective products resulting from the incompletely-fitted condition can be easily detected, and also malfunction due to the incompletely-fitted condition can be prevented.

When an impact force is accidentally applied to the retaining lever, the engagement between the lock portion and the lock arm retaining piece portion each having the obtuse angle is released to thereby relieve the impact force, so that damage to the constituent parts is prevented.

What is claimed is:

1. A connector, comprising:

a first connector having engagement shafts on opposite sides thereof;

a second connector having support shafts on opposite sides thereof;

a retaining lever pivotably disposed about said support shafts on said second connector, said retaining lever including fitting grooves for receiving said engagement shafts, respectively;

a lock portion formed on a front surface of said retaining lever directed in a direction of pivotal movement of said retaining lever; and a lock arm formed on said second connector, said lock arm having a retaining piece for engaging with said lock portion, holding the retaining lever in a provisionally-fitted condition when the first connector and the second connector are not completely fitted, and holding the retaining lever in a completely-fitted condition when the first connector and the second connector are completely fitted, wherein at least one of said retaining piece and said lock arm is elastically deformable.

2. The connector of claim 1, in which said lock portion includes a first long portion and a slanting slide surface slanted upwardly from an outer end of said first long portion, and said retaining piece includes a second long portion and an outer edge formed at a lower end of said second long portion, wherein said slanting slide surface is abutted against said outer edge during the pivotal movement of said retaining lever.

3. The connector of claim 1, in which said lock portion includes a first long portion and a first engagement surface extended at an obtuse angle relative to said first long portion, and said retaining piece includes a second long portion and a second engagement surface extended at an obtuse angle relative to said second long portion, wherein said first engagement surface engages with said second engagement surface when said retaining lever is in a completely-retained position.

4. A connector, comprising:

a first connector having engagement shafts on opposite sides thereof;

a second connector having support shafts on opposite sides thereof;

a retaining lever pivotably disposed about said support shafts on said second connector, said retaining lever including fitting grooves for receiving said engagement shafts, respectively;

a lock portion formed on a front surface of said retaining lever directed in a direction of pivotal movement of said retaining lever; and a lock arm formed on said second connector, said lock arm having a retaining piece for engaging with said lock portion and holding the retaining lever in a provisionally-fitted condition when the first connector and the second connector are not completely fitted, wherein at least one of said retaining piece and said lock arm is elastically deformable, and said lock portion includes a first long portion and a slanting slide surface slanted upwardly from an outer end of said first long portion, and said retaining piece includes a second long portion and an outer edge formed at a lower end of said second long portion, wherein said slanting slide surface is abutted against said outer edge during the pivotal movement of said retaining lever.

5. A connector, comprising:

a first connector having engagement shafts on opposite sides thereof;

a second connector having support shafts on opposite sides thereof;

a retaining lever pivotably disposed about said support shafts on said second connector, said retaining lever including fitting grooves for receiving said engagement shafts, respectively;

a lock portion formed on a front surface of said retaining lever directed in a direction of pivotal movement of said retaining lever; and a lock arm formed on said second connector, said lock arm having a retaining piece for engaging with said lock portion and holding the retaining lever in a provisionally-fitted condition when the first connector and the second connector are not completely fitted, wherein at least one of said retaining piece and said lock arm is elastically deformable, and said lock portion includes a first long portion and a first engagement surface extended at an obtuse angle relative to said first long portion, and said retaining piece includes a second long portion and a second engagement surface extended at an obtuse angle relative to said second long portion, wherein said first engagement surface engages with said second engagement surface when said retaining lever is in a completely-retained position.

* * * * *